US006981847B2

(12) United States Patent
Arinci et al.

(10) Patent No.: US 6,981,847 B2
(45) Date of Patent: Jan. 3, 2006

(54) SYSTEM FOR CONNECTING AND LOCKING ROTOR BLADES OF AN AXIAL COMPRESSOR

(75) Inventors: Paolo Arinci, Florence (IT); Carlo Bacciottini, Siena (IT)

(73) Assignee: Nuovo Pignone Holding S.p.A., Florence (IT)

( * ) Notice: Subject to any disclaimer, the term of this patent is extended or adjusted under 35 U.S.C. 154(b) by 58 days.

(21) Appl. No.: 10/319,462

(22) Filed: Dec. 16, 2002

(65) Prior Publication Data

US 2004/0037703 A1 Feb. 26, 2004

(30) Foreign Application Priority Data

Dec. 21, 2001 (IT) ..... MI2001A2783

(51) Int. Cl.
*F01D 5/32* (2006.01)

(52) U.S. Cl. ..... 416/193 A; 416/215; 416/218; 416/220 R

(58) Field of Classification Search ..... 416/220 R, 416/115–118, 221, 193 A, 244, 215, 216, 416/217, 218, 219 R, 244 A
See application file for complete search history.

(56) References Cited

U.S. PATENT DOCUMENTS

| | | | | |
|---|---|---|---|---|
| 2,315,631 | A * | 4/1943 | Lylod et al. | 416/216 |
| 3,088,708 | A * | 5/1963 | Feinberg | 416/215 |
| 3,216,700 | A * | 11/1965 | Bostock, Jr. | 416/216 |
| 3,567,337 | A * | 3/1971 | Zerlauth et al. | 416/221 |
| 3,954,350 | A * | 5/1976 | Zahring | 416/215 |
| 4,314,794 | A * | 2/1982 | Holden et al. | 416/97 A |
| 4,684,325 | A * | 8/1987 | Arnold | 416/215 |
| 4,859,149 | A * | 8/1989 | McClain | 416/215 |
| H1258 | H * | 12/1993 | Hindle, Jr. | 56/384 |
| 6,464,463 | B2 * | 10/2002 | Yvon Goga et al. | 416/215 |

* cited by examiner

*Primary Examiner*—Christopher Verdier
(74) *Attorney, Agent, or Firm*—Nixon & Vanderhye, P.C.

(57) ABSTRACT

System for connecting and locking blades which are fixed circumferentially to a rotor disc (1) of an axial compressor, comprising a plurality of blades (10, 10') positioned in an array along the circumference of rotor disc (1), each blade (10, 10') being provided with a shaped root (13) for connection to the rotor disc (1), and a dowel for positioning and locking the blades (10, 10') in a predetermined position in a circumferential seat (3) which has a shaped profile and which is formed along the circumference of the rotor disc (1). At least one insertion slot (4) intersects the circumferential seat (3) to permit the insertion of the roots (13) of the blades (10, 10') and the dowel.

7 Claims, 5 Drawing Sheets

SYSTEM FOR CONNECTING AND LOCKING ROTOR BLADES OF AN AXIAL COMPRESSOR

The present invention relates to a system for connecting and locking rotor blades of an axial compressor.

More precisely, the invention relates to a system for connecting and locking rotor blades which are fixed circumferentially and which are positioned in an array on the rotor disc of an axial compressor of a gas turbine.

The term "gas turbine" denotes the whole of a rotary beat engine which converts the enthalpy of a gas into useful work, using gases obtained directly from a combustion process and supplying mechanical power on a rotating shaft.

The turbine therefore usually comprises one or more compressors or turbocompressors, which compress air drawn in from the outside.

Various injectors supply the fuel, which is mixed with the air to form a fuel-air mixture for ignition.

The axial compressor is driven by a turbine, properly so called, or turboexpander, which supplies mechanical energy to a user by converting the enthalpy of the gases burnt in the combustion chamber.

The turboexpander, the turbocompressor, the combustion chamber (or heater), the output shaft for the mechanical energy, the control system and the starting system form the essential components of a gas turbine machine.

As regards the operation of a gas turbine, it is known that the fluid enters the compressor through a set of inlet ducts.

In these channels, the gas is characterized by low pressure and low temperature, but as it passes through the compressor the gas is compressed and its temperature rises.

It then enters the combustion (or heating) chamber, where it undergoes a further significant temperature rise.

The heat required to increase the gas temperature is supplied by the burning of liquid fuel introduced by injectors into the heating chamber.

The combustion is initiated by sparking plugs when the machine is started.

At the outlet of the combustion chamber, the gas, at high pressure and high temperature, passes through suitable ducts, reaches the turbine, where it gives up some of the energy accumulated in the compressor and in the heating (combustion) chamber, and then flows to the outside through the exhaust ducts.

Since the work transmitted by the gas to the turbine is greater than the work absorbed by the gas in the compressor, a certain quantity of energy remains in the shaft of the machine, and this work, after deduction of the work absorbed by the accessories and by the passive resistance of moving mechanical parts, constitutes the useful work of the machine.

Where the compressor is concerned, the maximum compression pressure is limited by the strength of the materials used.

Given the conditions of pressure, temperature and velocity of the rotating members in which the compressor is made to operate, it will be understood that the various components, and in particular the blading, are particularly stressed and therefore subject to rapid deterioration.

To enable maintenance and replacement to be carried out, the blades of the rotor disc are not made in one piece with it, but are fixed by their base projections which are inserted into suitable seats formed on the rim of the rotor disc.

In the connections of the rotor blades, the fixings are subjected, during the operation of the machine, to high perpendicular, bending, and possibly torsional stresses.

It will be appreciated, therefore, that the blade connection procedure is a crucial aspect of the design of any rotor.

In axial turbines, the most common type of blade fixing makes use of seats formed in the rotor disc, having sides with a grooved profile, in which the terminal portions, or roots, of the blades are engaged.

These seats can be made in the form of peripheral grooves extending essentially parallel to the axis of rotation of the rotor disc, so that the blades are inserted in an essentially axial direction.

A different type of blade fixing is provided by using what is known as circumferential fixing, in which a circumferential groove is formed on the outer circumference of the rotor disc to enable the blades to be inserted in the radial direction.

A particularly significant problem in the field of the design of rotor blades for axial compressors is the problem of providing connections which reduce to a minimum the down time for maintenance and replacement operations.

A first object of the present invention is therefore that of permitting the speedy assembly, dismantling and replacement of blades of the type fixed circumferentially to the rotor, by providing a blade connecting and locking system, with a reduced number of parts, which simplifies the removal of the locking devices and the replacement of the blades without any need to dismantle the rotor.

One disadvantage encountered in the connections of blades to rotor discs in the prior art is represented by the assembly tolerances: this is because excessive clearance in the assembly of the blades can cause dangerous vibrations, while the absence of such clearance can give rise to shrinkage due to the prevention of thermal expansion, causing additional stresses.

A second object of the present invention is therefore to provide a blade connecting and locking system which ensures correct assembly tolerances.

Another object of the present invention is to provide a system for connecting and locking rotor blades of an axial compressor which provides high reliability during the operation of the machine.

The system for connecting and locking blades which are fixed circumferentially to a rotor disc of an axial compressor according to the invention comprises the fixing of a plurality of blades positioned in an array along the circumference of a rotor disc, by the introduction of a shaped root of each blade, by the use of a means for positioning and locking the blades, into a circumferential seat formed along the circumference of the rotor disc, this seat being capable of housing slidably in a radial arrangement the roots of the blades and the positioning and locking means. At least one insertion slot, intersecting the said circumferential seat, is provided for the insertion of the roots of the blades and the positioning and locking means.

The characteristics of the system for connecting and locking rotor blades of an axial compressor according to the present invention will be made clearer by the following description and by the attached drawings, which relate to one embodiment, described by way of example and without restrictive intent, and in which.

Figure 1:
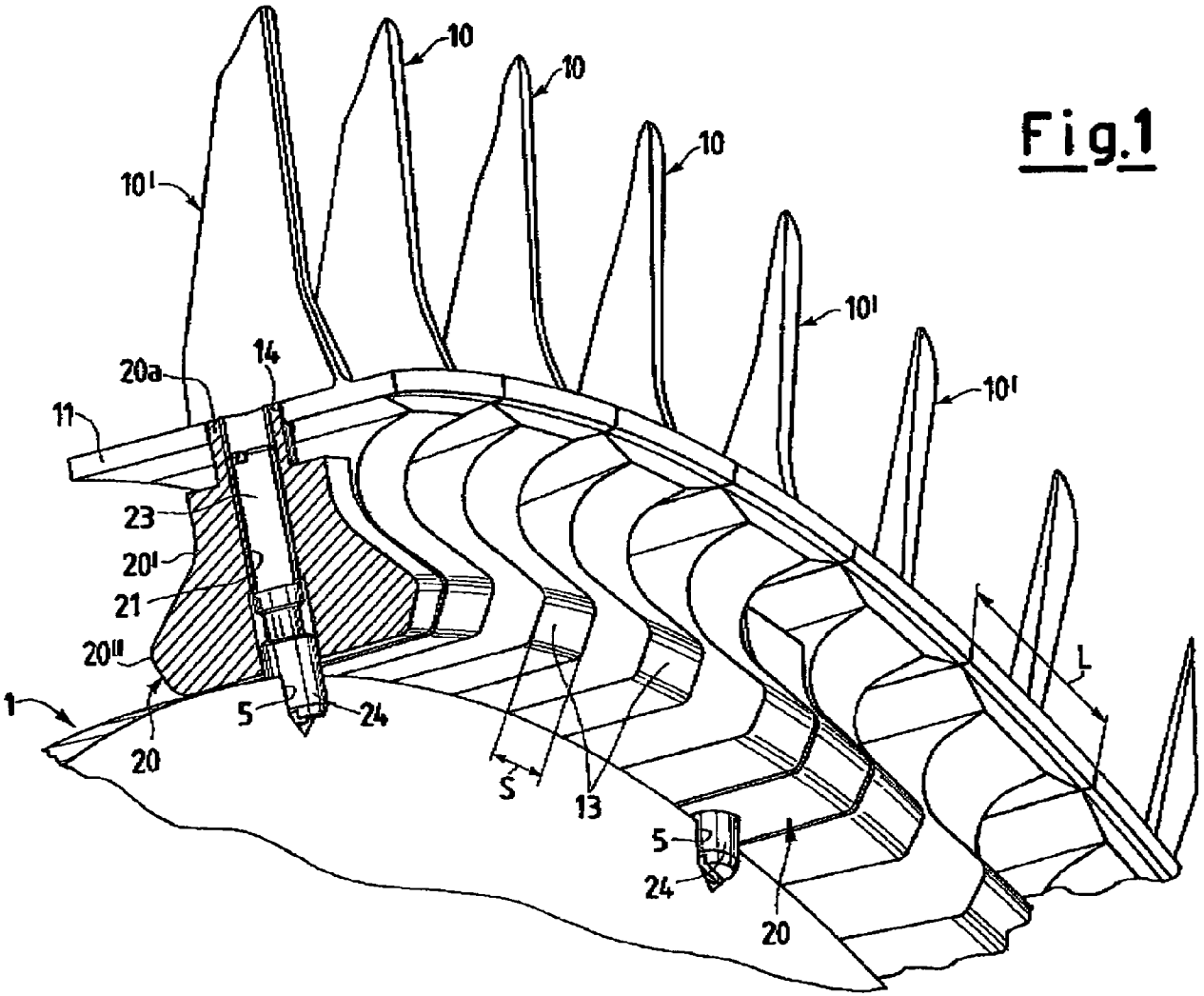
FIG. 1 is a perspective view of the connecting and locking system according to the invention.

With reference to the figures, a multi-stage axial compressor comprises a rotor disc 1 having a plurality of stages 2, each comprising, along its circumference, an array of circumferentially fixed blades 10.

The blades 10 of each array are essentially identical, since their aerodynamic and structural behaviour must be identical.

The structure of a blade 10 essentially comprises three main portions: a quadrangular platform 11, preferably trapezoidal; a portion with an aerodynamic profile 12 designed to compress the air and extending from the upper face of the platform 11, and a root 13 which acts as the fixing in the rotor disc 1 and extends from the lower face of the platform 11.

The root 13 is the portion by which the blade 10 is connected to the rotor disc 1, preventing the expulsion of the blade by centrifugal force.

The root 13 is shaped in such a way as to form a partial fixing in a correspondingly shaped circumferential seat 3, formed along the circumference of the rotor disc 1.

In this context, it should be pointed out that, although reference is made to a rotor disc 1 carrying the blades 10, in some compressors a plurality of blading stages are connected directly to the rotor shaft which is designed for the purpose, by the provision of a number of circumferential seats equal to the number of bladed stages to be fitted.

The fixing of the root 13 in the circumferential seat 3 is considered to be a partial fixing, since it allows the blade 10 to slide along the circumference of the rotor disc 1 but prevents its movement in the axial direction.

In order to form the partial fixing between the blade and disc, the root 13 of the blade 10 and the circumferential seat 3 have profiles which match each other, and which can be made in various forms to meet different requirements of design and construction.

The root 13, when seen from the front with respect to the direction of sliding in the circumferential seat 3, appears shaped in the form of a dovetail with rounded corners. As illustrated in FIG. 1, each root has opposite flat sides in the circumferential directions of the rotor disc.

In its upper part, in the portion near the platform 11, the root 13 has a pair of recesses 13' which can engage with corresponding counterparts 3' formed along the walls of the circumferential seat 3.

The root 13 also has at its base a pair of projections 13" retained in corresponding bends 3" formed in the walls of the circumferential seat 3 near the base.

Preferably, the recesses 13', the counterparts 3', the projections 13" and the bends 3" are made in pairs in the corresponding elements, but different forms of fixing which are equally effective can have only one shaped side.

The root 13 has a thickness s measured in the direction of sliding of the blade 10 within the circumferential seat 3, and extends centrally with respect to the platform 11 which has in the same direction a side whose measurement L is essentially equal to twice the thickness s.

The blades 10 are locked in the seat 3 by positioning and locking means, comprising at least one block 20, also shaped in the form of a dovetail with rounded corners, and having a thickness s essentially equal to the thickness of the root 13, subject to the various tolerances specified for assembly, and having a profile essentially reproducing that of the root 13, so that it can be inserted into, and slide within, the circumferential seat 3. As illustrated, block 20 has opposite flat sides in circumferential directions of the rotor disc.

In particular, the block 20 has in its upper part recesses 20' which reproduce the profiles of the counterparts 3' formed along the walls of the circumferential seat 3, and at its base a pair of projections 20" identical to the projections 13" of the roots 13 and capable of being retained in the bends 3" of the walls of the circumferential seat 3.

The block 20 also has a thickness s, measured in the direction of sliding of the blade 10 and the block 20 within the circumferential seat 3, which is essentially equal to the thickness s of the roots 13, subject to the necessary assembly tolerances.

To achieve effective locking, at least two blocks 20 are provided, these being positioned a certain distance apart, according to the procedures which will be made clear in the rest of the description.

Each block 20 has a central through hole 21, which passes vertically through it, for the insertion of a dowel 22.

The dowel 22 of each block 20 comprises a body 23 and a head 24 designed for engagement in part in a corresponding blind hole 5 formed in the base of the circumferential seat 3 for fixing each block 20 to the rotor disc 1.

For fixing the block 20 to the rotor disc 1, the central hole 21 is threaded in the area which houses the body 23 of the dowel, which is also correspondingly threaded. Accordingly, at least a portion of the dowel is threaded to enable threading the dowel in the hole 21.

Therefore, when the dowel 22 is screwed in, the head 24 is made to bear on the base of the blind hole 5, thus locking the corresponding block and consequently the whole array of blades 10.

To enable the roots 13 and the blocks 20 to be inserted radially into the circumferential slot 3, at least one insertion slot 4 is provided, intersecting the said circumferential seat 3.

Figure 2:
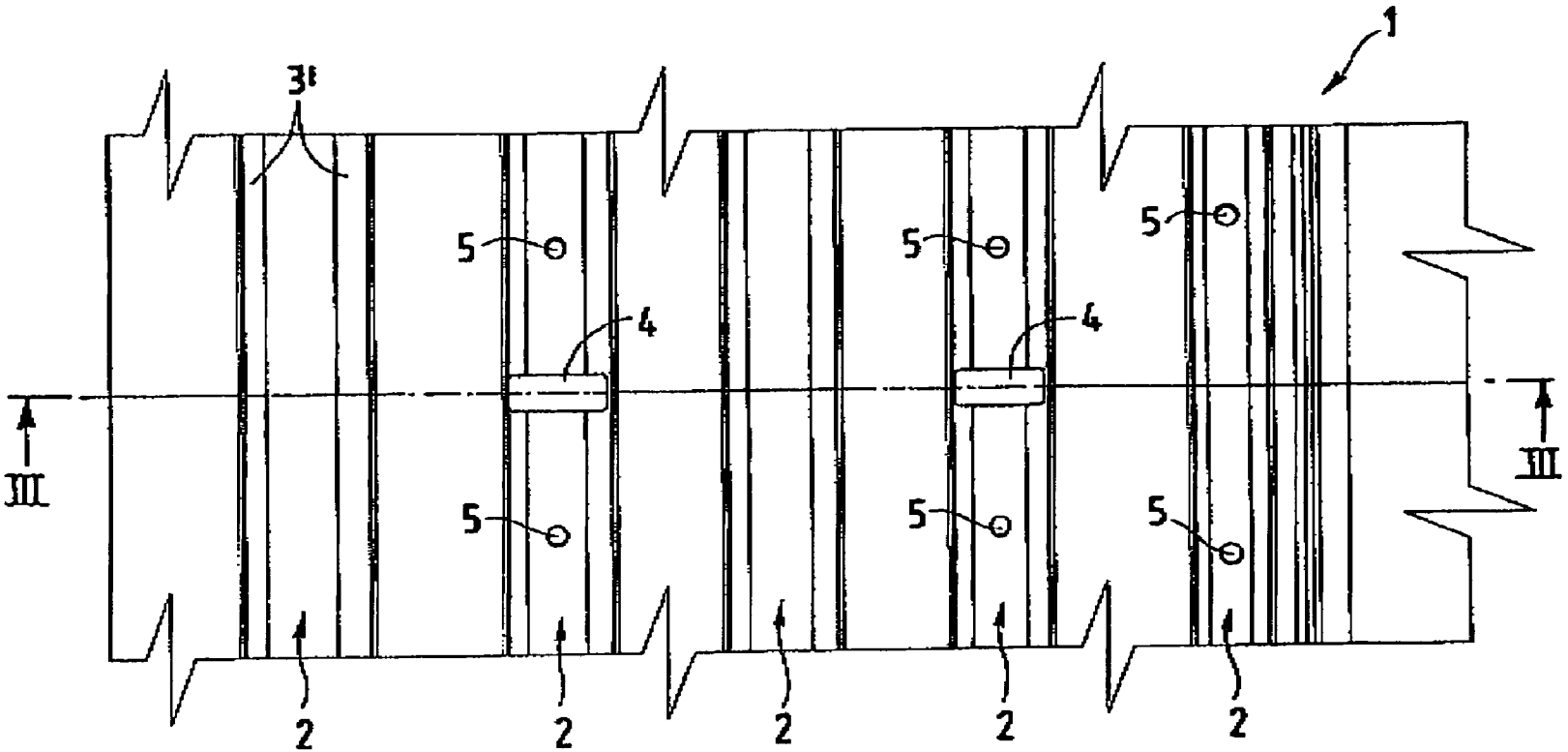
FIG. 2 is a partial plan view of a rotor disc designed for the connecting and locking system according to the invention.
Figure 3:
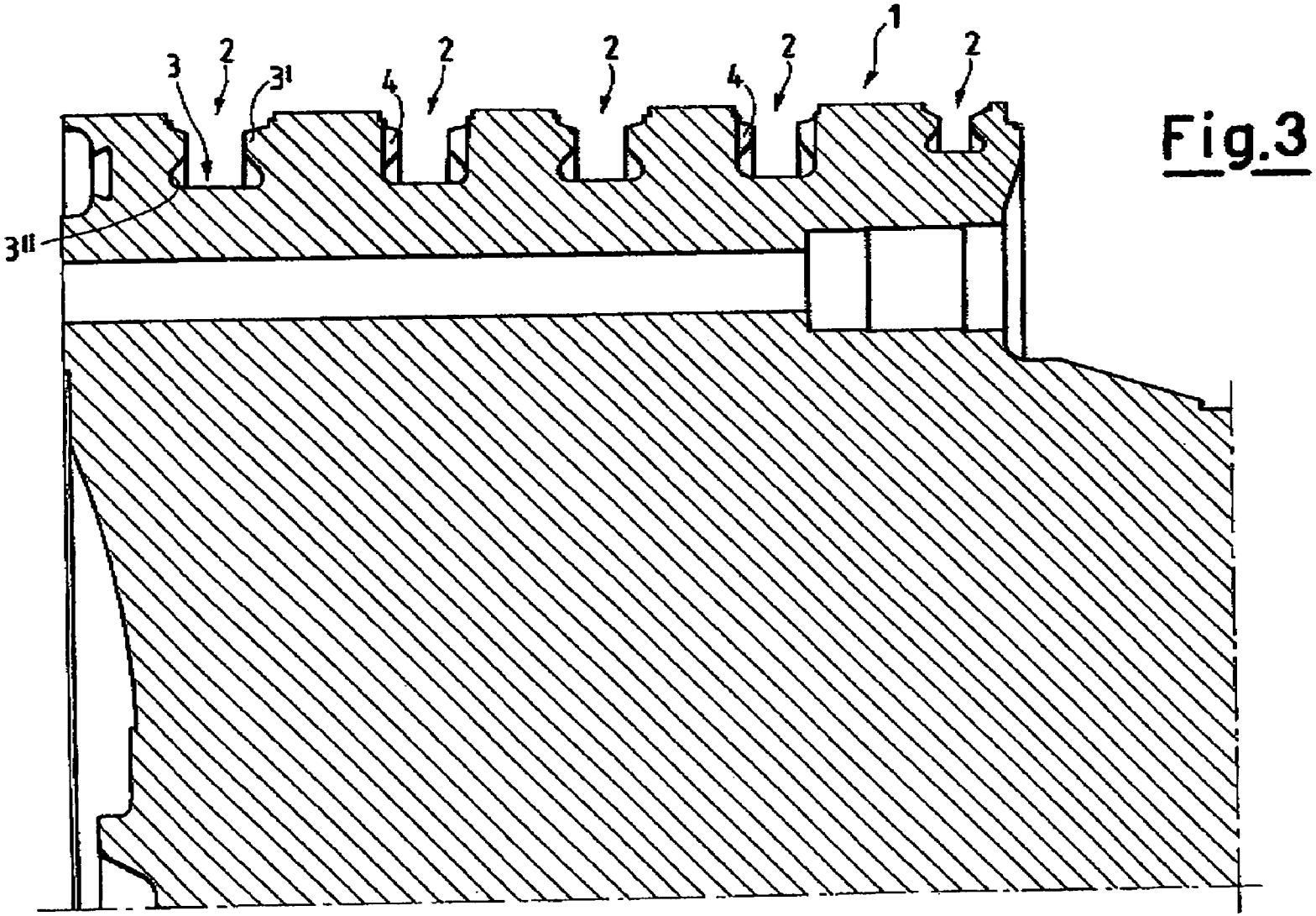
FIG. 3 is a section taken through the line III—III of FIG. 2.
Figure 4:
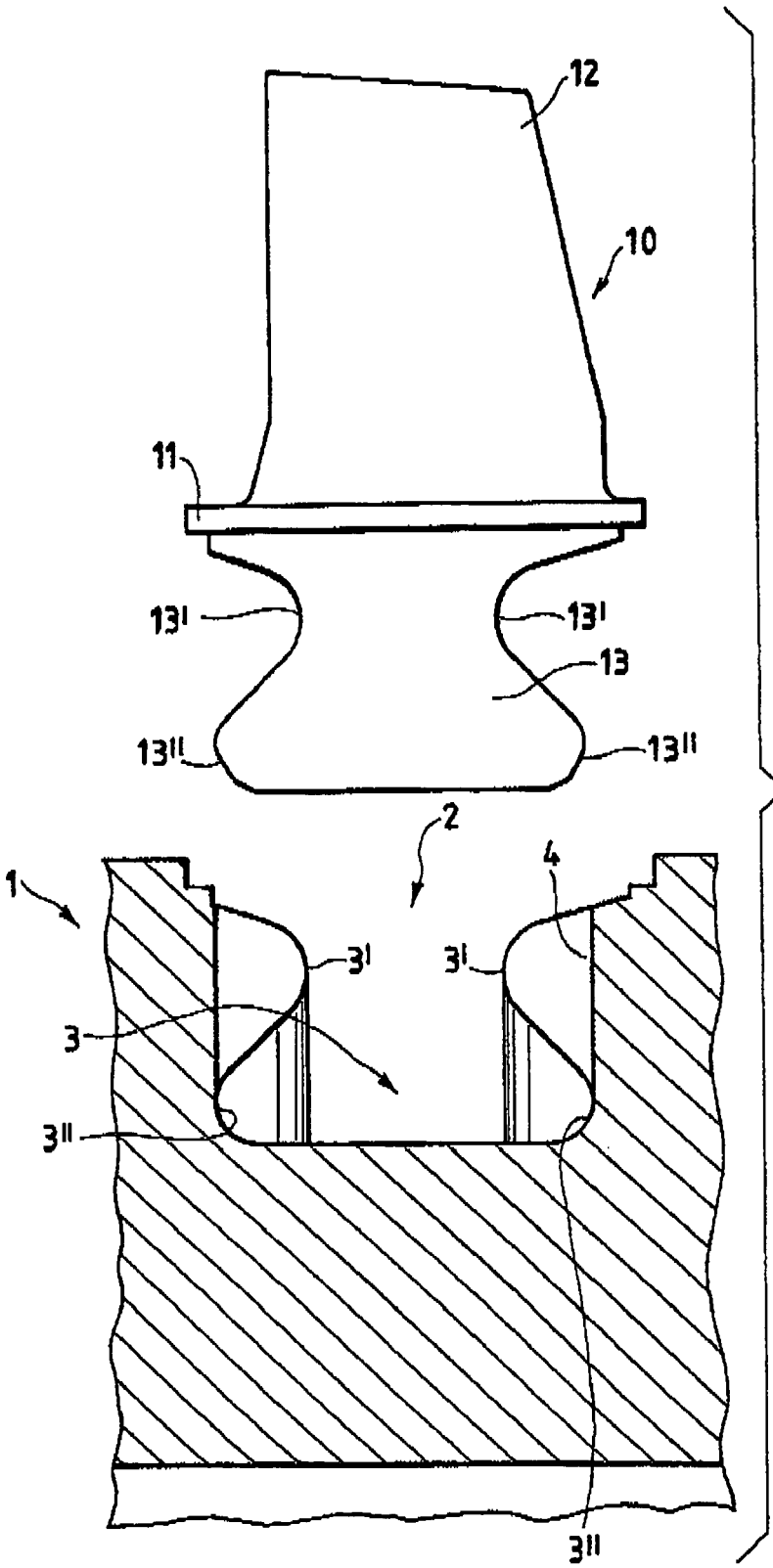
FIG. 4 is an exploded view in partial section of details of the system according to the present invention.
Figure 5:
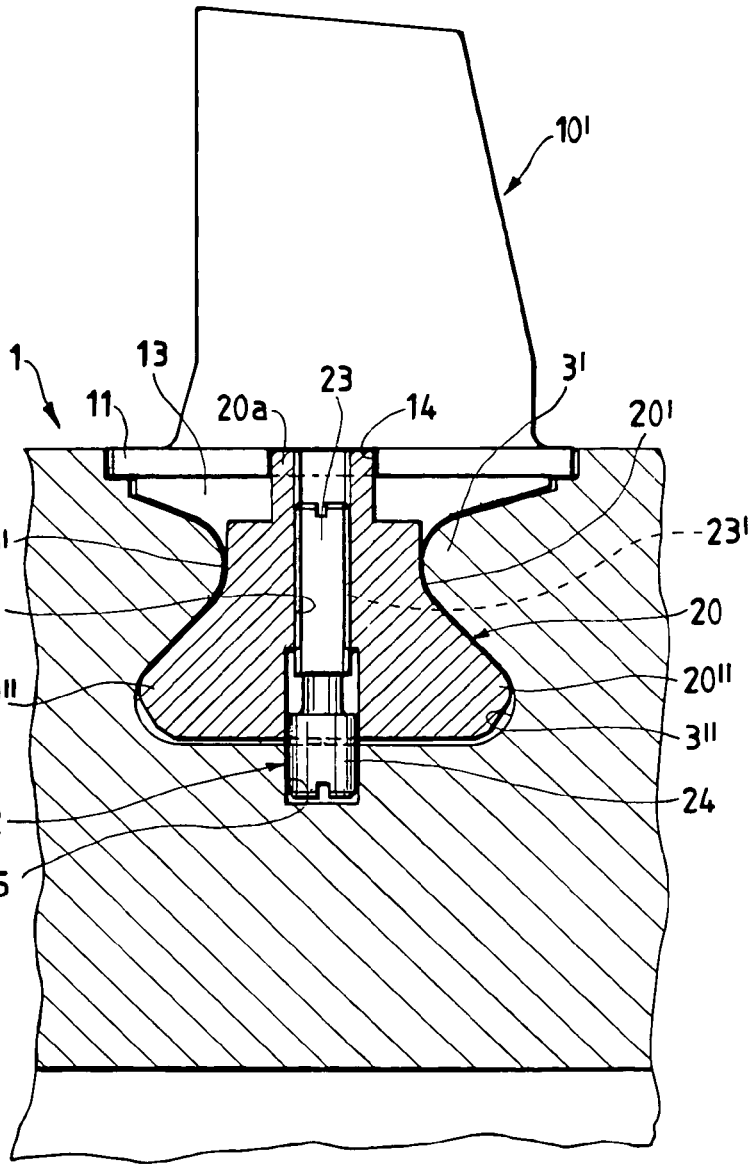
FIG. 5 is a schematic section illustrating the connecting and locking system according to the invention.
Figure 6:
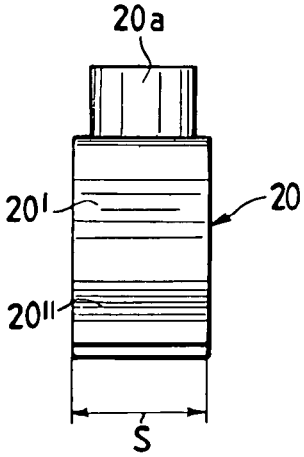
FIG. 6 is a lateral view of a detail of the system according to the invention.

Preferably, a single insertion slot 4 is provided, in order to increase the reliability of the system, but the provision of two insertion slots 4 in diametrically opposite locations with respect to the rotor disc provides better balancing during rotation. As illustrated in FIG. 2, the blind holes 5 are spaced apart symmetrically with respect to the insertion slot 4.

In this case, the components of the whole connecting and locking system are doubled.

The insertion slot 4 is, in practice, an aperture of essentially quadrangular shape, and its dimensions are slightly greater than the dimensions of the roots 13 and of the blocks 20, because sufficient assembly clearance is provided to enable the roots 13 and the blocks 20 to be inserted radially into the circumferential seat 3.

Pairs of securing blades 10', located next to each block 20, are also provided for the assembly of the system according to the invention.

These securing blades 10' are essentially identical to the blades 10, but each of them has an aperture 14, which is generally semicircular, or quadrangular if particular constructional requirements have to be met.

This aperture 14 is formed on the edge of the platform 11, adjacent to the corresponding edge of the other securing blade making up the pair.

These apertures are made in central positions, to allow access to the dowel 22.

In a corresponding way, a small block or bush 20*a* extends from the upper face of the block, this bush also being formed in a central position and having the central hole 21 passing through it.

The bush 20*a* is designed to be inserted into the said semicircular or quadrangular apertures 14 formed in the platforms 11 of the securing blades 10'.

If the apertures 14 are made quadrangular in order to meet constructional requirements, the bush is also made quadrangular.

In order to understand more clearly the advantages of the connecting and locking system according to the invention, reference should be made to its assembly on the rotor disc 1.

The blade 10 are first inserted through the insertion slot 4 and are slid circumferentially along the circumferential seat 3, after which a securing blade 10' is inserted, followed by a block 20 and then another securing blade 10', in such a way that the two semicircular apertures 14 are jointed to form an aperture which can receive the bush 20*a*.

Two other blades 10 are then inserted, and finally two more blades 10', with the second block 20 between them, are inserted in the same way as before.

Finally, the whole array is slid within the circumferential seat 3 until the two blocks 20, or more precisely their central holes 21, are brought in line with the blind holes 5, so that the dowels 22 can be screwed in until their heads 24 enter in part the blind holes 5.

When the assembly is complete, the blades 10 and the securing blades 10' are in contact with each other along the edges of their platforms 11 perpendicular to the direction of sliding of the blades, and a space is provided between the roots 13 of the two pairs of contiguous securing blades 10' for housing the blocks 20.

The decision to position and fix the blocks at a spacing enabling four blades, namely two blades 10 and two securing blades 10', to be placed between them, was made in order to provide an optimal solution to the problem of the tolerances and clearances required for carrying out the assembly.

However, it should be emphasized that this decision was also dependent on the dimensions of the blades of one stage, and that it could, therefore, be modified, with the insertion of a different number of blades 10 between the blocks.

In particular, this decision makes it possible to keep the blades which are close to the insertion slot 4 in their predetermined positions, and avoids a situation in which the insertion of a greater number of blades between the two blocks might, as a result of an unforeseen sum of tolerances, cause one of the blades to be too closely aligned with the insertion slot, thus risking the expulsion of this blade.

Advantageously, the provision of a single insertion slot for the whole array of blades of each stage of the rotor disc further reduces the possibility of occurrence of such problems.

In this context, it should be noted that, in the arrangement according to the preferred embodiment of the invention, on completion of assembly, two contiguous blades are positioned symmetrically with their platforms 11 covering the insertion slot 4, these platforms having the function of re-creating the flow duct in the areas above the root housing slot.

Therefore, given the values of the thickness s of the root 13, the width L of the platform 11 which is equal to twice the thickness s, and the width of the insertion slot 4 which is slightly greater than the thickness s, the roots of the two blades are essentially aligned in the insertion slot 4, and it is therefore easy to imagine how a minimal displacement of the blade could bring its root into a position of excessive projection into the insertion slot, thus making the locking unstable or even causing the blade to be expelled from the circumferential seat during the rotation of the rotor disc.

Finally, the arrangement according to the invention makes it possible to avoid an excessive closeness of the blocks which, by creating irregularities in the circular symmetry of the array of blades, perturb the rotation of the rotor disc.

The above description clearly indicates the characteristics of the connecting and locking of blades on a rotor disc of an axial compressor of a gas turbine which is the object of the present invention, and also makes clear the additional advantages, which include, in addition to those mentioned previously:

an increased average life of the components;

a higher rotation speed of the machine or an increase in the temperature of the fluid, or an appropriate combination of the two factors.

Finally, it is evident that the system designed in this way can be modified and varied in numerous ways, all included within the scope of the invention; moreover, all the components can be replaced with technically equivalent elements.

In practice, the materials used, as well as the shapes and dimensions, can be varied at will according to technical requirements.

What is claimed is:

1. A system for connecting and locking blades in an axial compressor, comprising:

a rotor disc having a circumferentially extending seat with a shaped profile formed about the circumference of the rotor disc, said shaped profile of said seat including axially opposed projections radially outwardly of axially opposed recesses adjacent a base of the seat, said seat base including at least one blind hole;

a plurality of blades circumferentially adjacent one another about the circumference of the rotor disc, each blade having an airfoil, a platform and a shaped root for connection to the rotor disc and reception in said seat, each said root having opposite flat sides in circumferential directions of said disc;

at least one block having a lateral profile with rounded corners, formed by a pair of recesses in a radial outer portion of the block for retention by the axially opposed projections of said seat, said block having a pair of projections in a radial inner portion thereof for reception in the axially opposed recesses of said seat, said block having a central generally radially extending through hole and opposite flat sides in circumferential directions of said disc;

a dowel for partial reception in said hole and having a body and a head, said block being received in said seat between a pair of next adjacent blades with said dowel head received in part in said blind hole to fix the block to the rotor disc against circumferential movement about the circumference of the rotor disk;

each said platform is quadrangular in shape, each said platform having a width in the circumferential direction of said rotor disc essentially equal to twice the thickness of the shaped roots of said blades in said circumferential direction, the width being essentially equal to twice the thickness of said one block, whereby in assembly of the blades a space is defined between adjacent blades sufficient to receive said one block.

2. A system according to claim 1 wherein said rotor disc includes at least one insertion slot at a predetermined circumferential location about said rotor disc and intersecting the circumferential seat to enable insertion of the shaped roots of the blades and said block.

3. A system according to claim 1 wherein the central hole of said block and a portion of said dowel are threaded to enable threading the dowel into the hole.

4. A system according to claim 1 wherein the platforms of said next adjacent blades have circumferentially registering apertures forming a through opening affording access to said dowel.

5. A system according to claim 4 wherein said block has a hollow bush adjacent a radially outermost portion thereof and the central hole passes through the bush, the bush being shaped for reception in said opening formed by the registering apertures of the adjacent platforms of the next adjacent blades.

6. A system according to claim 1 including a second block having a lateral profile with rounded corners, formed by a pair of recesses in a radial outer portion of said second block for retention by the axially opposed projections of said seat, said second block having a pair of projections in a radial inner portion thereof for reception of the axially opposed recesses of said seat, said second block having a central through hole, a second dowel for partial reception in said hole of said second block and having a body and a head, said second block being received in said seat between a second pair of next adjacent blades with said head of said second dowel received in part in another blind hole to fix the second block to the rotor disc.

7. A system according to claim 6 wherein said rotor disc includes at least one insertion slot intersecting said circumferential seat to permit the insertion of the shaped roots of said blades and said blocks, said blind holes being spaced apart symmetrically with respect to said insertion slot.

* * * * *

UNITED STATES PATENT AND TRADEMARK OFFICE

CERTIFICATE OF CORRECTION

PATENT NO. : 6,981,847 B2
DATED : January 3, 2006
INVENTOR(S) : Arinci, P. et al.

It is certified that error appears in the above-identified patent and that said Letters Patent is hereby corrected as shown below:

Title page,
Item [57], ABSTRACT,
Line 4, insert -- a -- between "circumference of" and "rotor disc".

Column 1,
Line 11, delete "beat" and insert -- heat --.

Column 4,
Line 26, delete "threaded." and insert -- threaded at 23'. --.
Line 27, delete "at least".

Column 5,
Line 11, delete "blade" and insert -- blades --.
Line 15, delete "jointed" and insert -- joined --.

Signed and Sealed this

Fourteenth Day of March, 2006

JON W. DUDAS
*Director of the United States Patent and Trademark Office*